United States Patent [19]

Schlangen et al.

[11] 4,177,007

[45] Dec. 4, 1979

[54] CENTRIFUGAL BLOWER CONTROL APPARATUS

[75] Inventors: Andrew J. Schlangen, La Crescent, Minn.; Jerry W. McClead, La Crosse; Thomas A. Garavalia, Stoddard, both of Wis.

[73] Assignee: The Trane Company, La Crosse, Wis.

[21] Appl. No.: 872,136

[22] Filed: Jan. 25, 1978

[51] Int. Cl.[2] ..... F01D 17/14

[52] U.S. Cl. ..... 415/160; 415/206

[58] Field of Search ..... 415/159, 160, 161, 204, 415/206

[56] References Cited

U.S. PATENT DOCUMENTS

| | | | |
|---|---|---|---|
| Re. 20,394 | 6/1937 | Anderson | 415/160 |
| 2,233,983 | 3/1941 | Kice | 415/160 |
| 2,435,091 | 1/1948 | Meyer | 415/160 |
| 2,435,092 | 1/1948 | Meyer | 415/160 |
| 2,439,933 | 4/1948 | Jenkins | 415/204 |
| 3,070,287 | 12/1962 | Eck | 415/206 |

*Primary Examiner*—Louis J. Casaregola
*Attorney, Agent, or Firm*—Carl M. Lewis; Peter D. Ferguson

[57] ABSTRACT

A centrifugal blower for air conditioning applications is shown having an adjustable inlet guide vane control for a blower wheel having forwardly curved blades. The pivot axis of each inlet guide vane is substantially offset or displaced from the plane of the inlet guide vane.

25 Claims, 8 Drawing Figures

CENTRIFUGAL BLOWER CONTROL APPARATUS

TECHNICAL FIELD

Over the years centrifugal blowers have evolved into three basic types. One type is known as the radial type wherein the blades of the wheel extend along a radius thereof. A second type, known as a BI fan, standing for backwardly inclined, has blades which are inclined rearwardly with respect to the direction of rotation of the blower wheel. Such blades may be of the air foil type to achieve higher efficiencies or modified operating characteristics. BI fans have deep inlet orifice rings. A third type, known as a FC fan, standing for forwardly curved, has blades which are inclined forwardly. FC fans have shallow inlet orifice rings.

BACKGROUND PRIOR ART

Inlet guide vanes have been used in the inlet orifice of blowers of the BI type to achieve volume control in air conditioning systems. However, for these applications it has not been considered desirable to use inlet vanes on FC fans. The inlet ring also offers insufficient space to locate the vane for efficient control.

DISCLOSURE OF THE INVENTION

The instant invention relates to a unique inlet guide vane control which has application to a blower of the forwardly curved type for air conditioning applications. The particular inlet guide vanes are uniquely positioned with respect to a blower of the forwardly curved type to provide the blower of this type with extremely desirable operating results, especially part-load operating horsepower.

The inlet guide vanes used to provide the part-load performance are uniquely oriented with respect to their pivot axes so as to provide a good seal between their radially outer arcuate edges and the blower inlet orifice ring while still permitting the vane pivots thereof to be mounted axially outwardly of the blower inlet orifice ring for easy access and service to the pivot bearings, etc. Such external mounting to the blower inlet, heretofore, would have required the radially outer end of the inlet guide vanes to be significantly notched or beveled so that the vanes could clear the inlet orifice ring when moved to the opened position. Such a notch or bevel permits excessive leakage between the inlet orifice ring and the radially outer edge of the guide vanes when the vanes are in the closed position. Our invention avoids this excessive leakage while at the same time permits the vanes to be externally mounted to the blower housing.

This achievement has been accomplished in the instant invention by displacing or offsetting the inlet guide vane substantially from its pivot axis. It is recognized by the inventors that a pivot shaft which might be fastened to one side of a guide vane would cause the vanes to be slightly offset from the axis of the pivot thereof by one-half the thickness of the shaft, plus one-half the thickness of the vane. Such slight offsetting of the pivot and vane would not be significant and would not achieve the results of this invention.

The desired substantial offset or displacement of the vane and pivot axis is achieved in the instant invention in two ways. In a first disclosed preferred embodiment, it is achieved by inclining or angularly displacing the body or plane of the inlet guide vane with respect to the vane pivot axis. In a second disclosed embodiment, it is achieved by spacing the body or plane of the inlet guide vane from the vane pivot axis.

Inlet guide vanes, when supported in accordance with the instant invention, may be disposed closer to the fan wheel for all pivoted positions of the vane.

Furthermore, inlet guide vanes supported in accordance with the instant invention may require fewer vanes because of their close spatial relationship with the blower wheel.

The inlet guide vane arrangement of the instant invention allows the vanes in a closed position to be disposed within the blower inlet orifice ring, even when the inlet orifice ring is of very narrow depth, thereby minimizing fluid leakage between the vanes and the orifice ring.

And still further, the pivot axis of the inlet guide vanes of the instant invention may be mounted externally of the blower housing inlet orifice ring for easy assembly and service.

These results are achieved by applicant's invention wherein the pivot axes of the guide vanes are displaced spatially and/or angularly a substantial amount from the inlet guide vane body or plane of the inlet guide vane body.

Specifically our invention involves a centrifugal blower apparatus including a centrifugal blower housing having an outlet opening and a side wall having an inlet opening; a centrifugal blower wheel disposed in said housing and mounted for rotation about an axis extending axially outwardly through said inlet opening; and disposed about said axis at said inlet opening a plurality of radially outwardly extending inlet guide vanes each having a radially outer edge and each, by way of a pivot, being pivotally adjustable between a fully opened position and a fully closed position; characterized in that a major portion, of each of said inlet guide vanes when pivotally adjusted to said closed position, being disposed axially inwardly of said side wall and a major portion, of each of said inlet guide vanes when pivotally adjusted to said fully opened position, being disposed axially outwardly of said side wall.

Additionally, our invention involves a centrifugal blower apparatus including a centrifugal blower housing having an outlet opening and a side wall having an inlet opening; a centrifugal blower wheel disposed in said housing and mounted for rotation about an axis extending axially outwardly through said inlet opening; an inlet orifice ring disposed about said axis at said inlet opening; and disposed about said axis at said inlet opening, a plurality of radially outwardly extending inlet guide vanes each having a radially outer edge and each, by way of a pivot, being pivotally adjustable between a fully opened position and a closed position; characterized in that a major portion, of each of said inlet guide vanes pivotally adjusted to said closed position, being disposed in an area axially co-extensive with said inlet orifice ring and a major portion, of each of said guide vanes pivotally adjusted to said fully opened position, being disposed axially outwardly of said inlet orifice ring.

And still further, our invention involves a centrifugal blower apparatus having a blower housing with an outlet and an inlet opening and a blower wheel within said housing mounted for rotation about a blower wheel axis extending through said inlet opening and wherein said inlet opening is provided with a set of pivotally adjustable inlet guide vanes characterized in that the pivot for each of said inlet guide vanes has an axis which is substantially displaced from the body of said inlet guide vane.

BRIEF DESCRIPTION OF THE DRAWINGS

These and other advantages will become more apparent as this specification describes our invention with reference to the drawings in which like numerals have been used throughout to designate like elements wherein.

BEST MODE FOR CARRYING OUT THE INVENTION

Figure 1:
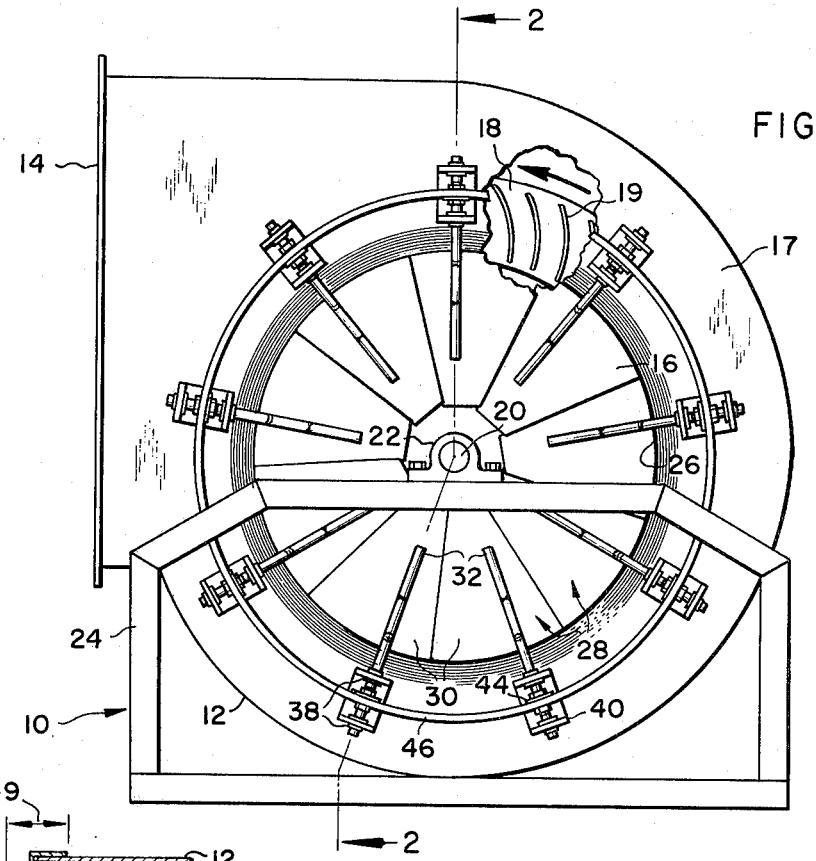
FIG. 1 is a side elevation of a centrifugal blower having forwardly curved blades and having inlet guide vanes incorporating the instant invention.

Centrifugal blower 10 has a housing 12 provided with an outlet opening 14 and an inlet opening 16 in housing side wall 17. Blower 10 also included a centrifugal blower wheel 18 with forwardly inclined and curved blades 19 disposed within housing 12 and mounted for rotation with shaft 20 and side bearings 22 (only one side bearing shown) supported by frame 24 connected to housing 12. Shaft 20 is rotated counterclockwise as viewed in FIG. 1 by any suitable motor means (not shown) as desired.

Disposed at inlet openings 16 within the inlet orifice ring 26 is a plurality of inlet guide vane assemblies 28 each comprised of a radially outwardly extending generally planar air deflecting inlet guide vane 30 and a guide vane support bar 32 having one end portion 34 extending substantially parallel to the plane of and rigidly connected to the inlet guide vane 30 as by welding. The other end portion or pivot 36 is pivotally supported in a pair of bearings 38 carried by a U-shaped bearing bracket 40 bolted to the exterior of side wall 17. A third or intermediate portion 50 of bar 32 connects portions 34 and 36.

Figure 2:
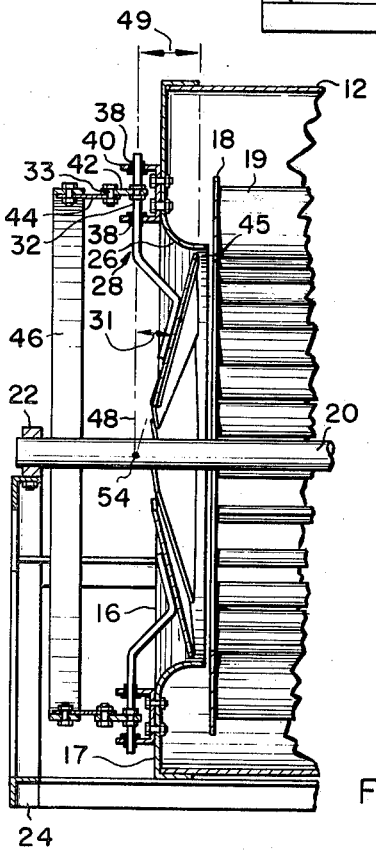
FIG. 2 is a section of a portion of the blower taken along lines 2—2 of FIG. 1.
Figure 4:
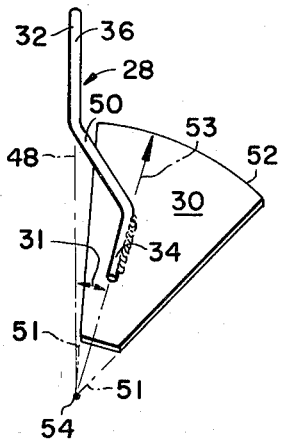
FIG. 4 is a perspective of a single inlet guide vane assembly of FIG. 1.
Figure 3:
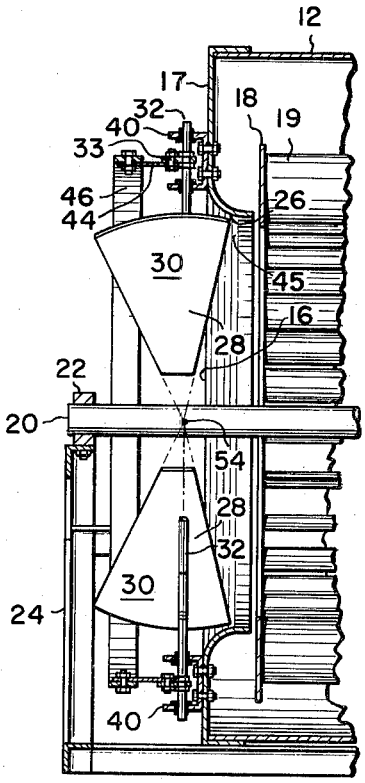
FIG. 3 is a view similar to FIG. 2 showing the inlet guide vanes thereof in the open position.
Figure 5:
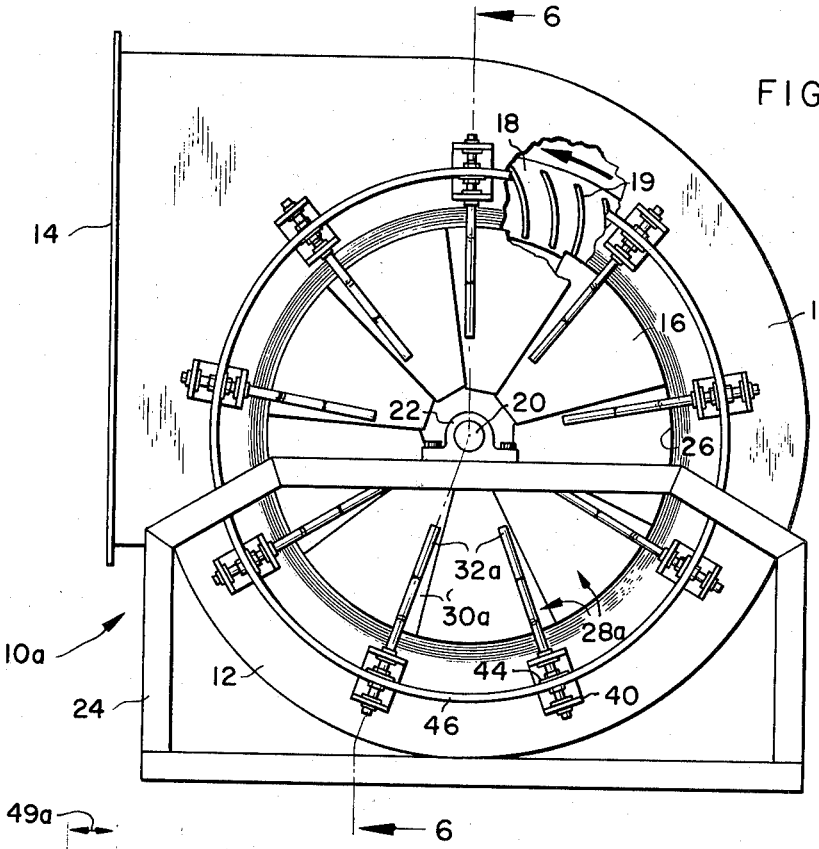
FIG. 5 is a side elevation of a centrifugal blower having forwardly curved blades and having inlet guide vanes incorporating modified form of the instant invention.
Figure 6:
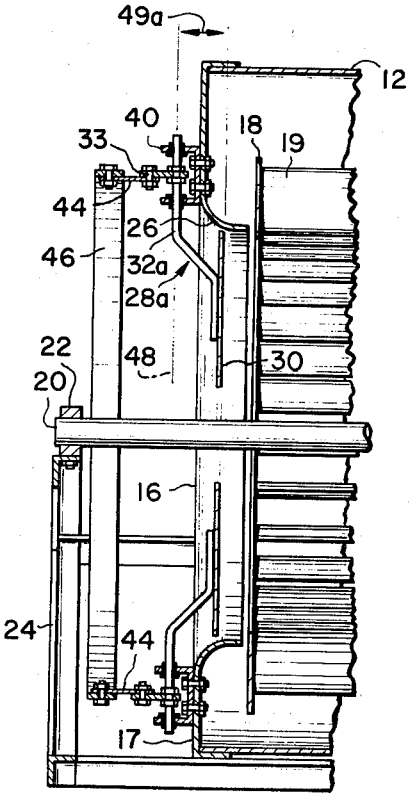
FIG. 6 is a section of a portion of the blower taken along lines 6—6 of FIG. 5.
Figure 8:
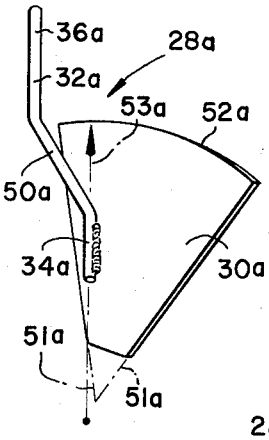
FIG. 8 is a perspective of a single inlet guide vane assembly of the modified form of FIG. 5.
Figure 7:
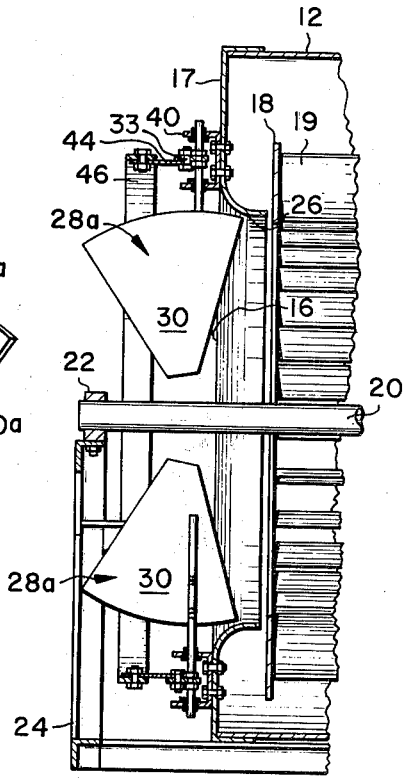
FIG. 7 is a view similar to FIG. 6 showing the inlet guide vanes thereof in the opened position.

Each of guide vane support bars 32 has a crankarm 42 rigidly connected thereto which in turn is pivotally connected at 33 to a resilient metallic strip 44 fastened rigidly to adjustment ring 46 which may be adjustably rotated counterclockwise as viewed in FIG. 1 about the axis of shaft 20 to adjust all the guide vanes in any position from their closed position shown in FIGS. 1 and 2 toward their fully opened position shown in FIG. 3. To close the vanes, ring 46 is rotated clockwise to the position shown in FIG. 1.

It will be noted that the change in clearance 45 between blower wheel 18 and the guide vanes 30 is relatively small from the opened to the closed position. This is accomplished by locating the pivot axis closer to the inner longitudinal edge than the outer longitudinal edge of vane 30. It will further be noted that each of guide vanes 30, when in the closed position, is almost entirely contained within the depth of the rather shallow inlet orifice ring 26 and disposed axially inwardly of side wall 17, while the pivot structure for the guide vanes is mounted on the external side of side wall 17 of the blower housing 12, a place of easy access. This unique relationship is made possible by substantially displacing the pivot axis 48 spatially 49 and/or angularly 31 from the guide vane 30.

In the embodiment shown in FIGS. 1–4 the pivot axis 48 is angularly displaced from the plane of vane 30 by an angle 31 of between 1 and 45 degrees and preferably 16 degrees whereby the radially outer edge 52 of vane 30 is spatially displaced a substantially greater distance from the pivot axis 48 (distance 49) than it is spaced from the blower housing side wall 17 as viewed in FIG. 2. This spatial and angular displacement is maintained by the portion 50 of vane support bar 32 intermediate portions 32 and 34.

In the embodiment shown in FIGS. 1–4 the straight lines 51, coinciding with the longitudinal edges of vane30, intersect at 54 with the center of curvature for radially outer edge 52 as indicated by radius 53 (an axis within vane 30). This point 54 of intersection is also the point of intersection of the axis of shaft 20 and pivot axis 48. In this embodiment this relationship holds true whether the vane 30 is positioned in the closed position of FIG. 2 or the opened position of FIG. 3. It will be understood that in the embodiment of FIGS. 1–4 that the vanes 30 when closed are generally arranged along a cone with each outer longitudinal edge slightly overlapping the inner longitudinal edge of the next adjacent vane.

In the modified embodiment of FIGS. 5–8 support bar **32*a* merely provides a spatial displacement 49*a* between pivot axis 48 and guide vane 30*a* as there is no angular displacement therebetween. This is accomplished by arranging the pivot portion 36*a* of support bar 32*a* in parallel but substantially spaced relationship with the plane of vane 30*a*. It will thus be seen that the vanes 30*a* when in the closed position of FIG. 6 lie generally within a common plane with slight overlapping (not shown) at their edges. It will also be noted from FIG. 8 that the straight lines 51*a* coinciding with the longitudinal edges of vane 30*a* do not intersect with the center of curvature for radially outer edges 52*a* as indicated by radius 53*a* (an axis within vane 30*a***) as these longitudinal edges have been modified to permit a slight overlapping of the vanes when in the closed position to further minimize leakage.

In both the embodiments it is possible to maintain very tight clearances without binding between the radially outer arcuate edge 52 or **52*a* of the guide vanes 30 or 30*a*, respectively, and the inner side of inlet orifice 26** because of their abutting relationship thereby minimizing leakage even when the inlet orifice ring or cone is relatively shallow. Furthermore, in both arrangements, the vane pivot is entirely external to the blower housing and inlet orifice ring which makes for easy assembly and access to the pivot elements.

INDUSTRIAL APPLICABILITY

While only flat vanes have been shown, it will be understood that contoured vanes may also be used with our invention. The invention may be applied also to radial or BI blowers. Thus it will be seen that by mounting inlet guide vanes in accordance with the teachings of our invention, the advantages heretofore described may be achieved. Furthermore, it will be appreciated that the mechanism for actuating the vanes to the open or closed position may be located radially inwardly rather than outwardly of the vanes if desired.

It is contemplated that many changes may be made without departing from the scope or spirit of our invention and we therefore desire that our invention be limited only by the claims.

We claim:

1. A centrifugal blower apparatus including a centrifugal blower housing having an outlet opening and a side wall having an inlet opening; a centrifugal blower wheel disposed in said housing and mounted for rotation about an axis extending axially outwardly through said inlet opening; a plurality of radially outwardly extending inlet guide vanes disposed about said axis at said inlet opening each having a radially outer edge; and pivot means, including a pivot at each of said vanes, for pivotally adjusting a major portion of each of said vanes between a fully closed position disposed in an area axially inwardly of said side wall and a fully open position disposed axially outwardly of said side wall.

2. A centrifugal blower apparatus according to claim 1 wherein said pivot for each of said inlet guide vanes is disposed outwardly of said side wall at the radially outer end of its respective inlet guide vane.

3. A centrifugal blower apparatus including a centrifugal blower housing having an outlet opening and a side wall having an inlet opening; a centrifugal blower wheel disposed in said housing and mounted for rotation about an axis extending axially outwardly through said inlet opening; an inlet orifice ring disposed about said axis at said inlet opening; a plurality of radially outwardly extending inlet guide vanes disposed about said axis at said inlet opening each having a radially outer edge; and pivot means, including a pivot at each of said vanes, for pivotally adjusting a major portion of each of said vanes between a fully closed position disposed in an area axially co-extensive with said inlet orifice ring and a fully open position disposed axially outwardly of said inlet orifice ring.

4. A centrifugal blower apparatus according to claim 3 wherein said inlet orifice ring is disposed axially between said side wall and said centrifugal blower wheel.

5. A centrifugal blower apparatus according to claims 3 or 4 wherein the pivot for each of said inlet guide vanes is disposed axially outwardly of said inlet orifice ring at the radially outer end of its respective inlet guide vane.

6. A centrifugal blower apparatus according to claims 3 or 4 wherein said radially outer edge, of each of said inlet guide vanes in said closed position, abuts said inlet orifice ring.

7. A centrifugal blower apparatus according to claims 1, 3, or 4 wherein the axes of the pivots substantially intersect with the axis of said centrifugal blower wheel.

8. A centrifugal blower apparatus according to claims 1, 3, or 4 wherein the axes of the pivots substantially intersect with and are substantially perpendicular to the axis of said centrifugal blower wheel.

9. A centrifugal blower apparatus having a blower housing with an outlet and an inlet opening and a blower wheel within said housing mounted for rotation about a blower wheel axis extending through said inlet opening and wherein said inlet opening is provided with a set of pivotally adjustable inlet guide vanes characterized in that the pivot for each of said inlet guide vanes has an axis which is substantially displaced from the body of said inlet guide vane.

10. A centrifugal blower apparatus according to claims 1, 3, 4, or 9 characterized in that said blower wheel has forwardly inclined and curved blades.

11. A centrifugal blower apparatus according to claims 1, 3, 4, or 9 wherein said inlet guide vanes in said closed position are substantially perpendicular to said axis of said centrifugal blower wheel.

12. A centrifugal blower apparatus according to claims 1, 3, 4, or 9 wherein said inlet guide vanes in said closed position are inclined radially outwardly and toward said blower wheel.

13. A centrifugal blower apparatus according to claim 9 characterized in that the pivot axis of said inlet guide vane and an axis within said inlet guide vane substantially intersect at said blower wheel axis.

14. A centrifugal blower apparatus according to claim 9 characterized in that the pivot axis of said inlet guide vane is angularly displaced from said inlet guide vane.

15. A centrifugal blower apparatus according to claim 14 characterized in that the pivot axis of said inlet guide vane and an axis within said inlet guide vane substantially intersect at said blower wheel axis.

16. A centrifugal blower apparatus according to claim 14 characterized in that the pivot axis of said inlet guide vane is angularly displaced from said inlet guide vane between 1 and 45 degrees.

17. A centrifugal blower apparatus according to claim 16 characterized in that the pivot axis of said inlet guide vane and an axis within said inlet guide vane substantially intersect at said blower wheel axis.

18. A centrifugal blower apparatus according to claim 9 characterized in that the pivot axis of said inlet guide vane is substantially spaced from said inlet guide vane.

19. A centrifugal blower apparatus according to claim 9 characterized in that the pivot axis of said inlet guide vane is substantially spaced from and substantially angularly displaced from said inlet guide vane.

20. A centrifugal blower apparatus according to claim 19 characterized in that the pivot axis of said inlet guide vane and an axis within said inlet guide vane substantially intersect at said blower wheel axis.

21. A centrifugal blower apparatus according to claim 9 characterized in that said inlet guide vane has two radially inwardly extending straight edges, straight lines coinciding with said edges intersecting with each other at said blower wheel axis.

22. A centrifugal blower apparatus according to claims 1, 3, or 4 characterized in that the axis of the pivot of said inlet guide vane is substantially spaced from said inlet guide vane.

23. A centrifugal blower apparatus according to claims 1, 3, 4, or 9 characterized in that the axis of the pivot of said inlet guide vane is substantially spaced and parallel to said inlet guide vane.

24. An inlet guide vane assembly for a blower comprising: a generally planar air deflecting inlet guide vane; a pivot means having an axis about which said inlet guide vane pivots; said pivot axis lying generally substantially outside the plane of said inlet guide vane; a bar extending from said pivot means to said inlet guide vane; said bar having a first portion extending substantially parallel to said pivot axis, a second portion extending substantially parallel to the plane of said inlet guide vane and rigidly fastened to said inlet guide vane, and a third portion intermediate said first and second portions which is not parallel to either said first portion or said inlet guide vane.

25. A centrifugal blower apparatus having a housing with an outlet opening and a side wall with an inlet opening; a blower wheel within said housing mounted for rotation about a blower wheel axis extending through said inlet opening; a set of radially outwardly extending inlet guide vanes disposed about said axis at said inlet opening and each having a radially outer edge; pivot means at each of said vanes for pivotally adjusting said radially outer edge about a pivot axis to a closed vane position having greater distance from said pivot axis than from said blower housing side wall.

* * * * *